United States Patent [19]

Sadvary et al.

[11] Patent Number: 4,575,025

[45] Date of Patent: Mar. 11, 1986

[54] FIN DEPLOYMENT MECHANISM FOR MISSILES

[76] Inventors: John W. Sadvary, 40 Notch Park Rd., Little Falls, N.J. 07424; Tim C. Fung, 1241 Miriam Pl., Hillside, N.J. 07205

[21] Appl. No.: 603,690

[22] Filed: Apr. 25, 1984

[51] Int. Cl.[4] ..... F42B 13/32

[52] U.S. Cl. ..... 244/3.27; 244/49

[58] Field of Search ..... 244/3.24–3.3, 244/49, 213, 215; 74/89.15, 107, 99 A

[56] References Cited

U.S. PATENT DOCUMENTS

| | | | |
|---|---|---|---|
| 1,793,056 | 2/1931 | Carns . | |
| 3,731,546 | 5/1973 | MacDonald | 74/89.15 |
| 3,765,340 | 10/1973 | Brothers | 102/237 |
| 4,029,014 | 6/1977 | Cunningham | 102/337 |
| 4,241,652 | 12/1980 | Smedlund . | |
| 4,336,914 | 6/1982 | Thomson . | |

FOREIGN PATENT DOCUMENTS 2949292 6/1981 Fed. Rep. of Germany ..... 244/3.29

*Primary Examiner*—Harold J. Tudor

[57] ABSTRACT

What is proposed by the invention is a fin deployment mechanism for missiles in which a fin member can be extended from or retracted to the contour of a missile by means of a rotary to linear motion transmission system employing a rotatable screw shaft having respective adjacent portions embodying a left hand and a right hand thread for supporting respective ones of a pair of screw nuts, each of which are provided with a cam slot for receiving a cam follower mounted on the fin member, or fin supporting member, so that when the screw shaft rotates the screw nuts are caused to move therealong in mutually opposite directions and via the cooperation between the cam slots and the cam followers the fin is caused to rotate through a given angle. In each of the extreme positions of the fin member a locking engagement is effected for retaining such positions in a locked condition.

7 Claims, 2 Drawing Figures

FIG 1
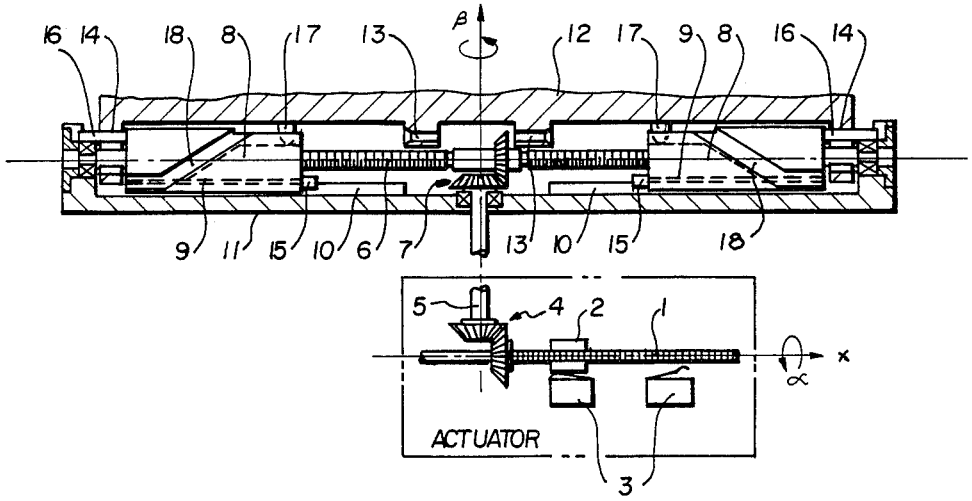
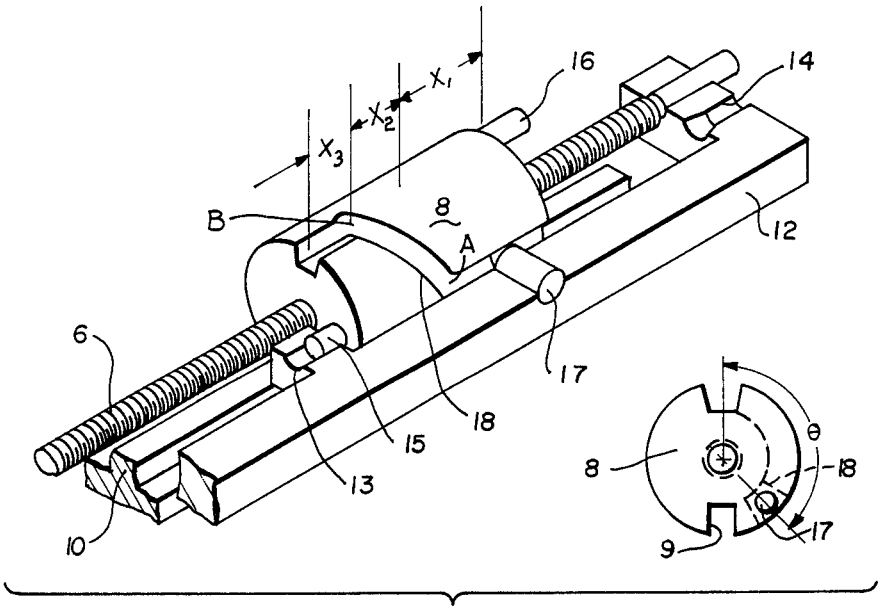
FIG 2

FIN DEPLOYMENT MECHANISM FOR MISSILES

BACKGROUND OF THE INVENTION

The present invention relates to devices for unfolding and refolding a control surface, that is, a fin or fin members from the body of an airborn projectile, such as a missile and the like. Conventional fin development mechanisms use either simple mechanical spring mechanisms, or pyrotechnic and pneumatic techniques that are irreversible, that is, once the fin is deployed to an unfolded position it cannot be refolded. Should the launch of such a missile be canceled the missile then cannot be returned to its stored position. Further, the presence of pyrotechnics presents a hazard to operational personnel, the missile itself and the missile-carrying aircraft. In the case of pneumatic operation a charged gas pressure storage vessel is required for unlocking torsional springs which then snap the fin into place. A pressure source might well prove hazardous in an airborn environment, not to mention the added weight of the storage vessel. There is, therefore, a genuine need for a retractable fin deployment mechanism which will avoid the above deficiencies.

SUMMARY OF THE INVENTION

The present invention relates to an electromechanical device that is readily contained within the airfoil contour of the missile and will permit, as well, the fins or control surfaces of the missile to be unfolded and rigidly locked into place. The same mechanism will also unlock the fin and retract it into the folded position if, for example, the launch of the missile is canceled. According to the principles of the invention a simple and sturdy electromechanical device that is both compact and incorporates relatively few moving parts provides for uniform displacement of a fin, either towards or away from an extended position in which positive engagement between the parts of the device and the fin are continually maintained, thus preventing free play and hence lost motion during the operation of the device.

To accomplish the above objects there is provided according to the principles of the invention a rotary to linear movement device which acts directly on the hinge line of the fin to be deployed or retracted. The rotary movement is transmitted via a main shaft which can be manually turned or rotated by an electrically operated imput torque from a power imput shaft having a switch actuating nut threaded thereon for limiting the rotation of the shaft either one way or the other. The main shaft is connected by beveled gears to a jackscrew shaft at the center thereof and thus divides the jackscrew shaft into a right-hand thread portion and a left-hand thread portion, each of which support for axial movement therealong an Acme-type screw nut that is provided with a cam slot for engaging a cam follower on the fin member. Axial movement of the Acme threaded nuts either away from or towards each other will cause the fin to rotate about its hinge line by virtue of the respective cam followers riding the cam slots of the axially moving Acme nuts. In each of the extreme positions (extended or retracted) the respective screw nuts engage a locking means.

The invention will be better understood as well as further objects and advantages thereof become more apparent from the ensuing detailed description taken in conjunction with the drawings.

BRIEF DESCRIPTION OF THE DRAWINGS

FIG. 1 is a schematic diagram of the fin deployment mechanism according to the invention; and FIG. 2 is a perspective view of the fin deployment mechanism showing the linear displacement of the right hand screw nut.

DETAILED DESCRIPTION

Referring now to FIG. 1 there is shown a power input shaft 1 which may be rotated manually or electrically driven by a suitable motor mechanism, not shown. If the latter means is used as an imput torque then there is also provided a screw nut 2 disposed on the shaft 1 so that the screw nut actuates the switches 3 which in turn control the on-off operation of the motor input and thus limit the rotation of the input shaft either clockwise or counterclockwise. By means of the bevel gears 4 the gear shaft 5 is caused to rotate and thus transmit the input torque from the input shaft 1 to the jackscrew shaft system 6 on the center line of the shaft 6, as shown, by means of the bevel gears 7. There are two self-locking Acme screws which includes a right hand thread on the right hand side of the bevel gears 7 and a left hand thread on the left hand side of the gears. On each of the thread portions of the shaft 6 is disposed a screw nut. Rotation of each nut 8 is restricted by the cooperation of a channel 9 in the nut 8 with a rail member 10 extending along the main mounting beam 11. Thus each nut 8 travels in a linear direction, that is, the $\pm x$ direction, as shown. The fin or control surface mounting beam 12 is provided with two extensions having locking holes therein 13 and 14, as best shown in FIG. 2, for each of the right hand thread and the left hand thread. These locking holes cooperate respectively with the locking pins 15 and 16, to be more fully described below. Also provided on the fin mounting structure 12 is a ball bearing-type cam follower 17 for cooperation with a cam slot 18 in each of the screw nuts 8, as shown in FIGS. 1 and 2. Thus, movement of the nut 8 in the $\pm x$ direction will cause the fin structure 12 to rotate about the center line of the shaft 6 through the angle $\theta$, as best shown in FIG. 2.

The operation of the fin deployment mechanism is as follows and will be described with respect to FIG. 2 which shows only the right hand side of the system, it being understood, of course, that the left hand side operates in a similar but opposite fashion. The locking pin 15 extending from the screw nut 8 is shown positioned in the locking hole 13, thus restricting movement of the fin mounting beam or structure 12 which is shown in the folded or closed position. When the right hand thread of screw shaft 6 begins to rotate in the $-\alpha$ direction, the screw nut 8 moves in the $+x$ direction. The rolling cam follower 17 is in the linear section of the cam slot 18; consequently, there is no angular displacement of the fin structure 12 by means of the linear displacement of the screw nut 8.

Continued movement of the screw nut 8 in the $+x$ direction, however, causes the cam follower 17 to reach a relative guiding groove position of the cam slot marked A, as shown. At this point the locking pin 15 has completely moved out of the hole 33 of the fin mounting structure 12. Further movement of the screw nut 8 causes the rolling cam 17 to enter the helix section $X_2$ of the cam slot and in turn causes the fin mounting beam 12 to rotate in the $-\theta$ direction, which unfolds the fin.

By the time the rolling cam follower 17 reaches the groove position marked B, the fin mounting beam 12 has assumed an angular value or displacement $\theta$ which is equal to the desired value. The locking pin 16, extending from the screw nut 8 in the opposite direction to that of the pin 15, is now aligned with the locking hole 14 on the fin mounting beam 12, and the cam follower 17 is then at the linear section $X_3$ of the cam slot 18.

Further movement of the screw nut 8 in the +x direction causes the locking pin 16 to enter the locking hole 14 of the fin mounting beam 12 resulting in the locking of the fin in the deployed position. Once the fin mounting beam 12 is in the locked position, the stroke control switch 3 is tripped by the switch actuation nut 2, thereby cutting off the power to the actuating mechanism. Naturally the entire process just described can be reversed by putting the fin mounting beam 12 back into its original folded, that is, retracted position.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A control surface deployment apparatus for missiles, comprising a control surface supporting member having cam follower means thereon and a locking means thereon, a screw nut means having (1) a cam slot means on the exterior surface thereof for receiving said cam follower means and imparting arcuate motion thereto for a first portion thereof and no motion thereto for a second portion thereof and (2) an engaging means integral with said screw nut means for engaging said locking means, a screw shaft means for supporting said screw nut means along the axis thereof, and means for rotating said screw shaft means to axially translate said screw nut means, whereby said control surface supporting member via the cooperation of said cam follower means and said cam slot means is caused to rotate through a given angle of rotation whose limits are defined by a retracted position and an extended position of said control surface supporting member with respect to the contour of said missile, and further wherein said engaging means engages said locking means in each of said retracted and extended positions when said cam follower means is stationary in said second portion of said cam slot means.

2. An apparatus according to claim 1, wherein said screw nut means comprise a pair of screw nuts threaded oppositely of each other for movement away and towards each other on said screw shaft means.

3. An apparatus according to claim 2, wherein said screw shaft means comprise two sections oppositely threaded from one another for supporting respectively each of said pair of screw nuts.

4. An apparatus according to claim 1, wherein said engaging means comprise a pair of pin members extending coaxially of said screw nut means, each of said pair extending in an opposite direction from each other.

5. An apparatus according to claim 4, wherein said locking means on said fin supporting member comprise recess means for receiving respective ones of said pin members.

6. An apparatus according to claim 1, wherein said first portion of said cam slot means defines a helix section and said second portion defines a coaxial linear section.

7. An apparatus according to claim 1, wherein said screw nut means is provided with a coaxially extending slot therein for engaging a rail member.

* * * * *